US007305197B2

(12) United States Patent
Kinouchi et al.

(10) Patent No.: US 7,305,197 B2
(45) Date of Patent: Dec. 4, 2007

(54) FIXING DEVICE OF IMAGE FORMING APPARATUS

(75) Inventors: Satoshi Kinouchi, Tokyo (JP); Osamu Takagi, Tokyo (JP); Yoshinori Tsueda, Shizuoka-ken (JP); Toshihiro Sone, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 287 days.

(21) Appl. No.: 11/080,909

(22) Filed: Mar. 16, 2005

(65) Prior Publication Data

US 2006/0210291 A1 Sep. 21, 2006

(51) Int. Cl.
*G03G 15/20* (2006.01)

(52) U.S. Cl. ..... 399/67; 219/619; 399/328

(58) Field of Classification Search ..... 399/38, 399/67, 68, 69, 70, 88, 328; 219/216, 600, 219/619

See application file for complete search history.

(56) References Cited

U.S. PATENT DOCUMENTS

| | | | |
|---|---|---|---|
| 6,026,273 | A | 2/2000 | Kinouchi et al. |
| 6,078,781 | A | 6/2000 | Takagi et al. |
| 6,087,641 | A | 7/2000 | Kinouchi et al. |
| 6,097,926 | A | 8/2000 | Takagi et al. |
| 6,137,985 | A | 10/2000 | Kinouchi et al. |
| 6,154,629 | A | 11/2000 | Kinouchi et al. |
| 6,337,969 | B1 | 1/2002 | Takagi et al. |
| 6,415,128 | B1 | 7/2002 | Takagi et al. |
| 6,438,335 | B1 | 8/2002 | Kinouchi et al. |
| 6,643,476 | B1 | 11/2003 | Kinouchi et al. |
| 6,643,491 | B2 | 11/2003 | Kinouchi et al. |
| 6,724,999 | B2 | 4/2004 | Kikuchi et al. |
| 6,725,000 | B2 | 4/2004 | Takagi et al. |
| 6,763,206 | B2 | 7/2004 | Kinouchi et al. |
| 6,861,627 | B2 | 3/2005 | Wasai et al. |
| 6,861,630 | B2 | 3/2005 | Kinouchi et al. |
| 6,868,249 | B2 | 3/2005 | Kinouchi et al. |
| 6,871,041 | B2 | 3/2005 | Takagi et al. |
| 6,889,018 | B2 | 5/2005 | Kinouchi et al. |

(Continued)

FOREIGN PATENT DOCUMENTS

JP 2000-293059 A 10/2000

(Continued)

OTHER PUBLICATIONS

U.S. Appl. No. 10/945,395, filed Sep. 21, 2004, Kinouchi et al.

(Continued)

*Primary Examiner*—Hoan Tran
(74) *Attorney, Agent, or Firm*—Foley & Lardner LLP

(57) ABSTRACT

A fixing device of an image forming apparatus of the present invention enables induction heating coils for a 100 V power source to set a ratio of inductance L to load resistance R of a heat roller to $L/R < 35\times10^{-6}$ (H/Ω) and coil impedance Z (Ω) to Z<10 (Ω) and supplies a drive current at a high frequency of 40 to 70 kHz. By doing this, an eddy current generated in the heat roller is concentrated upon a metallic conductive layer by the skin effect and the heat generation efficiency of the heat roller is improved.

22 Claims, 7 Drawing Sheets

U.S. PATENT DOCUMENTS

| | | | | |
|---|---|---|---|---|
| 6,898,409 | B2 | 5/2005 | Tsueda et al. | |
| 6,900,419 | B2 | 5/2005 | Takagi et al. | |
| 7,046,939 | B2 * | 5/2006 | Kinouchi et al. | 399/88 |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |

FOREIGN PATENT DOCUMENTS

| | | | |
|---|---|---|---|
| JP | 2002-237377 | A | 8/2002 |

OTHER PUBLICATIONS

U.S. Appl. No. 10/805,514, filed Mar. 22, 2004, Kinouchi et al.
U.S. Appl. No. 10/944,707, filed Sep 21, 2004, Sone et al.
U.S. Appl. No. 10/944,855, filed Sep. 21, 2004, Sone et al.
U.S. Appl. No. 10/820,138, filed Apr. 8, 2004, Sone et al.
U.S. Appl. No. 10/805,305, filed Mar. 22, 2004, Sone et al.
U.S. Appl. No. 10/805,420, filed Mar. 22, 2004, Sone et al.
U.S. Appl. No. 10/799,770, filed Mar. 15, 2004, Kikuchi et al.
U.S. Appl. No. 10/805,507, filed Mar. 22, 2004, Kikuchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/805,308, filed Mar. 22, 2004, Tsueda et al.
U.S. Appl. No. 10/378,859, filed Mar. 5, 2003, Sone et al.
U.S. Appl. No. 11/078,421, filed Mar. 14, 2005, Takagi et al.
U.S. Appl. No. 11/078,725, filed Mar. 14, 2005, Takagi et al.
U.S. Appl. No. 11/080,833, filed Mar. 16, 2005, Tsueda et al.
U.S. Appl. No. 11/078,726, filed Mar. 14, 2005, Tsueda et al.
U.S. Appl. No. 11/082,218, filed Mar. 17, 2005, Tsueda et al.
U.S. Appl. No. 11/080,942, filed Mar. 16, 2005, Kinouchi et al.

* cited by examiner

| | EXPERIMENT 3 | EXPERIMENT 4 |
|---|---|---|
| FREQUENCY f (kHz) | 60 | 40 |
| INDUCTANCE L ($\mu$H) | 80 | 85 |
| LOAD RESISTANCE R ($\Omega$) | 4.1 | 3.2 |
FIG. 8
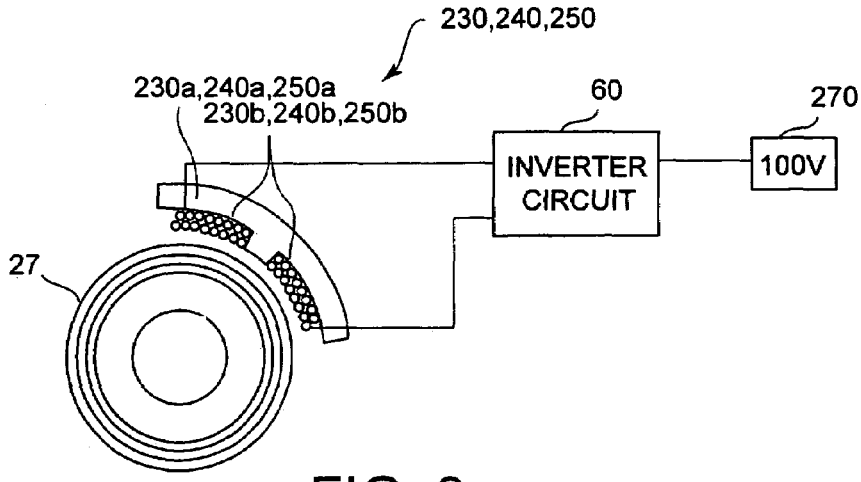
FIG. 9
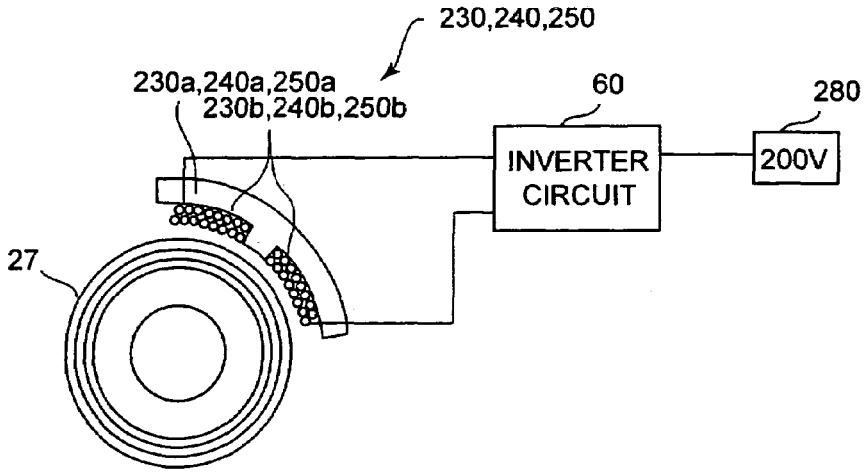
FIG. 10

| | EXPERIMENT 5 | EXPERIMENT 6 |
|---|---|---|
| FREQUENCY f (kHz) | 40 | 20 |
| INDUCTANCE L ($\mu$H) | 28 | 30 |
| LOAD RESISTANCE R ($\Omega$) | 1.7 | 1.1 |

FIG. 11

| | EXPERIMENT 7 | EXPERIMENT 8 |
|---|---|---|
| FREQUENCY f (kHz) | 80 | 50 |
| INDUCTANCE L ($\mu$H) | 26 | 27 |
| LOAD RESISTANCE R ($\Omega$) | 2.6 | 1.9 |

FIG. 12

FIXING DEVICE OF IMAGE FORMING APPARATUS

FIELD OF THE INVENTION

The present invention relates to a fixing device of an image forming apparatus loaded in the image forming apparatus such as a copier, a printer, or a facsimile for heating and fixing a toner image onto a sheet of paper using induction heating.

BACKGROUND OF THE INVENTION

As a fixing device used in an image forming apparatus such as an electro-photographic copier or printer, there is a fixing device for inserting a sheet of paper through a nipping section formed between a pair of rollers composed of a heat roller and a pressure roller or between similar belts and heating, pressurizing, and fixing a toner image. As such a heating type fixing device, conventionally, there is an apparatus for heating a metallic conductive layer on the surface of a heat roller or a heat belt by the induction heating method. The induction heating method supplies predetermined power to an induction heating coil to generate a magnetic field, instantaneously heats the metallic conductive layer by an eddy current generated by the magnetic field, and can fix the heat roller or heat belt.

As such a fixing device of the induction heating method, for example, in Japanese Patent Application Publication No. 2002-237377, to prevent the frequency of the induction heating coil from reducing to an audio frequency of 20 kHz or less, an apparatus for retaining a fixed heating output without generating a noise is disclosed. However, this fixing device of the conventional induction heating method uses a low frequency not reaching the audio frequency to realize cut-down of cost of the apparatus.

On the other hand, in recent years, in a fixing device of the induction heating method, a fixing device for installing a thinned metallic conductive layer having a small heat capacity on the surface of a heat roller to realize fast heating of the metallic conductive layer and realizing more energy conservation has been developed. In such a thinned metallic conductive layer with a small heat capacity, when the induction heating coil is driven at a frequency of about 20 to 40 kHz by a conventionally used inverter circuit, the surface depth of an eddy current generated in the metallic conductive layer is large, so that the leakage rate of the magnetic flux is increased, and the efficient heating is disturbed.

Therefore, in a fixing device having an installed thinned metallic conductive layer, development of a fixing device of an image forming apparatus characterized in that when heating the metallic conductive layer, the magnetic flux of an eddy current generated in the metallic conductive layer by the induction heating coil leaks little, and heat generation of the metallic conductive layer is efficient, and speeded fixing and energy conservation can be realized, and the profitability and environmental maintenance are excellent is desired.

SUMMARY OF THE INVENTION

An aspect of the present invention is to provide a fixing device for heating a metallic conductive layer by an induction heating coil in which magnetic flux of an eddy current generated in the metallic conductive layer leaks a little, and heat generation of the metallic conductive layer is efficient, and speeded fixing and energy conservation are realized, and profitability and environmental maintenance are retained.

According to one embodiment of the present invention, there is provided a fixing device of an image forming apparatus including a heating device having a conductive heat generation layer for heating a toner image on a medium pressure device pressed to the heating device that conveys the medium in a predetermined direction, and an induced current generation device arranged near the heating device that sets a ratio of a load resistance R (Ω) generated between an inductance L (H) and the heating means device to $L/R<35\times10^{-6}$ (H/Ω) and generates an induced current in the heat generation layer. A current control device supplies a drive current at a frequency of 40 kHz or higher to the induced current generation device.

BRIEF DESCRIPTION OF THE DRAWINGS

FIG. 8 is a table showing characteristics of the induction heating coil of the second embodiment of the present invention;

FIG. 9 is a schematic block diagram showing the heating system of the heat roller by a power source of 100 V of the third embodiment of the present invention;

FIG. 10 is a schematic block diagram showing the heating system of the heat roller by a power source of 200 V of the third embodiment of the present invention;

FIG. 11 is a table showing characteristics of the induction heating coil by a power source of 100 V of the third embodiment of the present invention; and FIG. 12 is a table showing characteristics of the induction heating coil by a power source of 200 V of the third embodiment of the present invention.

DESCRIPTION OF THE EMBODIMENTS

Figure 1:
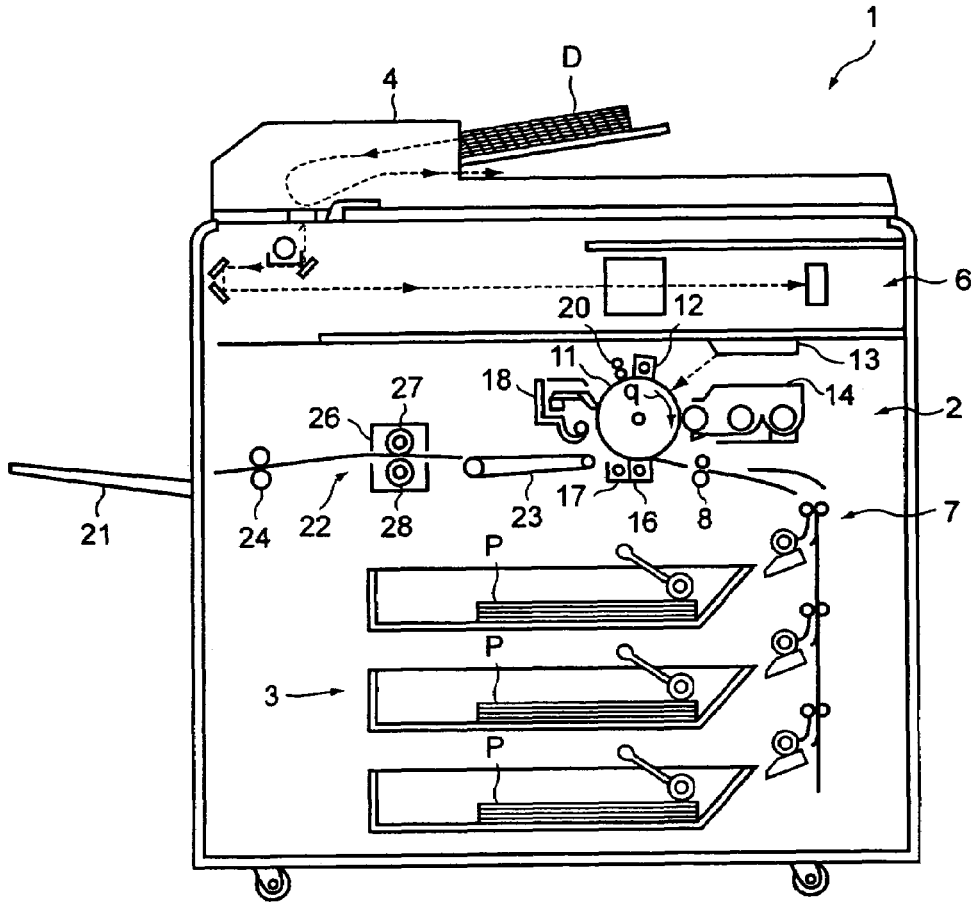
FIG. 1 is a schematic block diagram showing the image forming apparatus of the first embodiment of the present invention.

Hereinafter, the embodiments of the present invention will be explained in detail with reference to the accompanying drawings. FIG. 1 is a schematic block diagram showing image forming apparatus 1 loading fixing device 26 of the embodiments of the present invention. Image forming apparatus 1 has cassette mechanism 3 for feeding sheets of paper P, which are media to be fixed, to image forming unit 2 and has scanner section 6 for reading documents D fed by automatic document feeder 4 on the top thereof. On conveyor path 7 from cassette mechanism 3 to image forming unit 2, register rollers 8 are installed.

Image forming unit 2 includes, around photosensitive drum 11, charger 12 for uniformly charging photosensitive drum 11 sequentially according to the rotational direction of arrow q of photosensitive drum 11, laser exposure apparatus 13 for forming latent images on charged photosensitive drum 11 on the basis of image data from scanner 6, developing apparatus 14, transfer charger 16, separation charger 17, cleaner 18, and discharging LED 20. Image forming unit 2 forms toner images on photosensitive drum 11 by the known image forming process by the electro-photographic method and transfers them onto sheets of paper P.

On the downstream side of image forming unit 2 in the conveying direction of sheets of paper P, ejection paper conveyor path 22 for conveying sheets of paper P on which toner images are transferred toward paper ejection section 21 is installed. On ejection paper conveyor path 22, conveyor belt 23 for conveying sheets of paper P separated from photosensitive drum 11 to fixing device 26 and paper ejection rollers 24 for ejecting sheets of paper P after passing fixing device 26 to paper ejection section 21 are installed.

Figure 2:
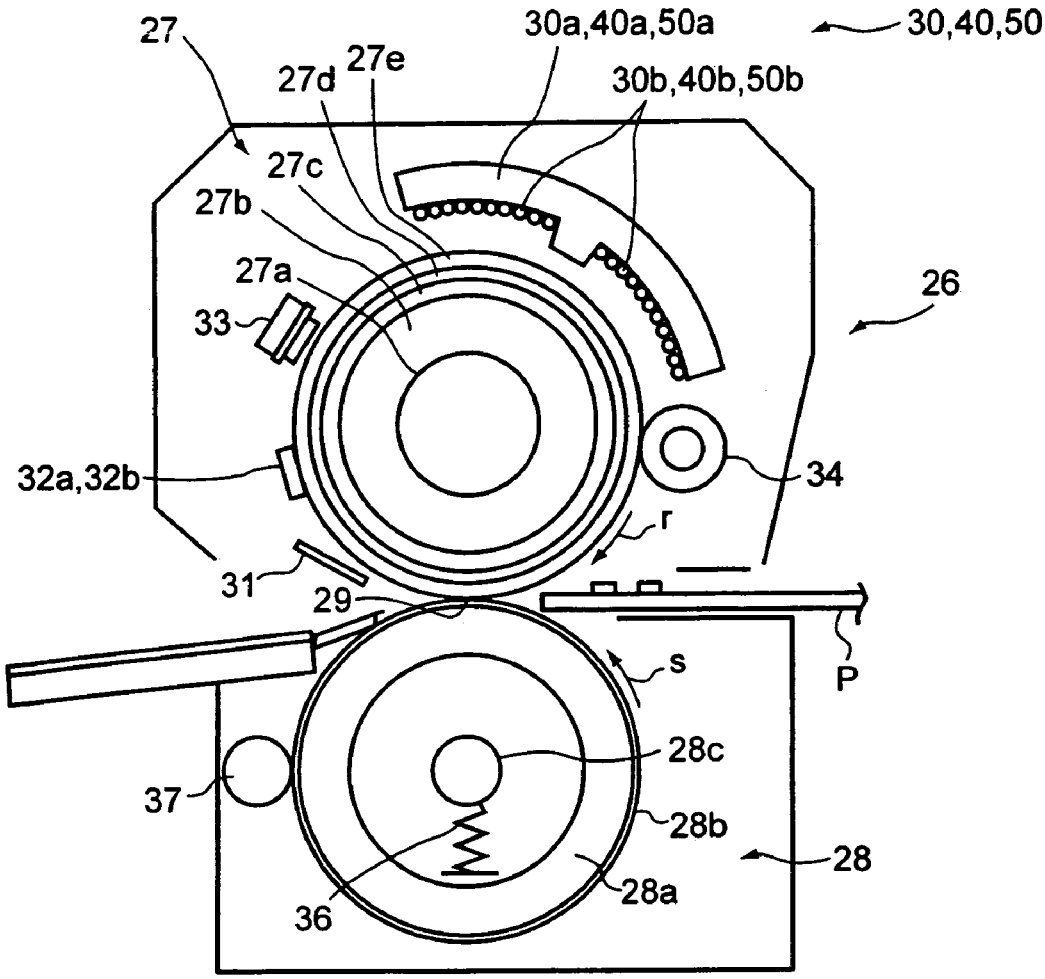
FIG. 2 is a schematic block diagram showing the fixing device of the first embodiment of the present invention.
Figure 3:
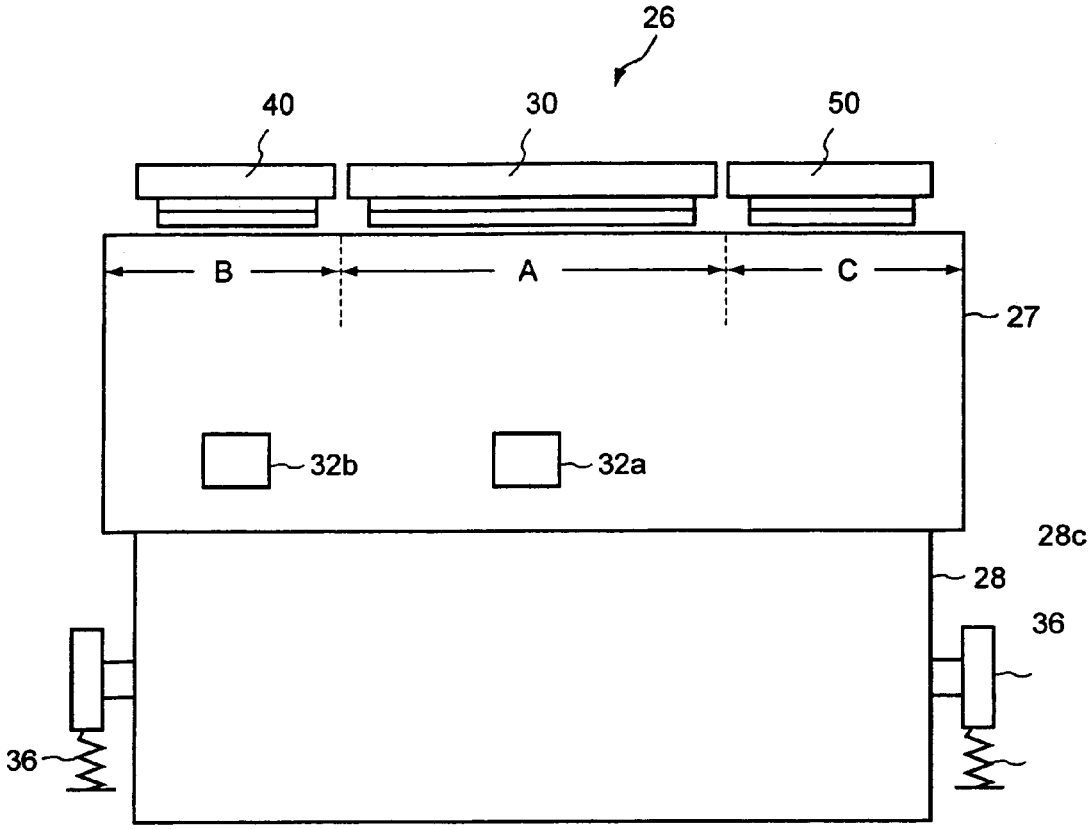
FIG. 3 is a schematic side view showing the fixing device of the first embodiment of the present invention.
Figure 4:
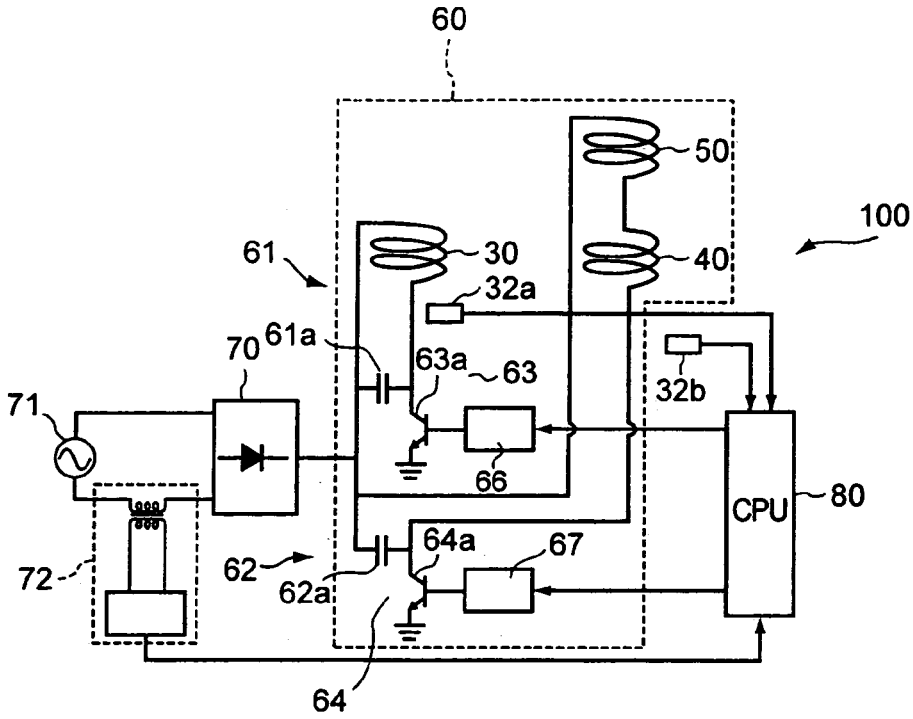
FIG. 4 is a schematic block diagram showing the heating control system of the heat roller of the first embodiment of the present invention.

Next, fixing device 26 will be described. FIG. 2 is a schematic block diagram showing fixing device 26, and FIG. 3 is a schematic side view showing fixing device 26, and FIG. 4 is a block diagram showing control system 100 for heating heat roller 27. Fixing apparatus 26 has heat roller 27 which is an endless member and pressure roller 28 which is a pressure member pressed to heat roller 27. Furthermore, fixing device 26 has induction heating coils 30, 40, and 50 which are an induced current generation means for a 100 V power source for heating heat roller 27 via a gap of about 3 mm on the outer periphery of heat roller 27. Induction heating coils 30, 40, and 50 are in an almost coaxial shape with heat roller 27.

Furthermore, on the outer periphery of heat roller 27, separation pawl 31 for preventing sheets of paper P after fixing from wrapping, thermistors 32*a* and 32*b* for detecting the surface temperature of heat roller 27, thermostat 33 for detecting an abnormal surface temperature of heat roller 27 and interrupting heating, and a cleaning roller 34 are installed. In heat roller 27, around core bar 27*a*, expanded rubber 27*b* with a thickness of 5 mm, metallic conductive layer 27*c*, made of nickel (Ni), with a thickness of 40 μm, solid rubber layer 27*d* with a thickness of 200 μm, and release layer 27*e* with a thickness of 30 μm are sequentially formed to a diameter of 40 mm. Solid rubber layer 27*d* and release layer 27*e* form a protective layer.

Pressure roller 28 is composed of core bar 28*a* around which surface layer 28*b* such as silicone rubber or fluorine rubber is coated in a diameter of 40 mm. Pressure roller 28, since shaft 28*c* is pressed by pressure spring 36, is pressed to heat roller 27. By doing this, between heat roller 27 and pressure roller 28, a fixed nipping width is formed. Further, around pressure roller 28, cleaning roller 37 is installed.

Induction heating coils 30, 40, and 50 are respectively supplied with a driving current, generate a magnetic field, generate an eddy current in metallic conductive layer 27*c* by this magnetic field, and heat metallic conductive layer 27*c*. Induction heating coils 30, 40, and 50 respectively heat areas A, B, and C of hear roller 27 in the longitudinal direction. Induction heating coils 30, 40, and 50 have the same structure though they are different in length. Induction heating coils 30, 40, and 50 are composed of magnetic material cores 30*a*, 40*a*, and 50*a* around which electric wires 30*b*, 40*b*, and 50*b* are wound 11 turns. Electric wires 30*b*, 40*b*, and 50*b* using heat resistant polyamide-imide copper wires are composed of a litz wire of 50 bundled copper wires with a wire diameter of 0.3 mm. Electric wires 30*b*, 40*b*, and 50*b* are formed as a litz wire, so that an AC current can flow effectively. Namely, the copper loss of electric wires 30*b*, 40*b*, and 50*b* can be suppressed.

Induction heating coils 40 and 50 for heating areas B and C on both sides of heat roller 27 are connected in series and are driven under the same control. Depending on a case of fixing large sheets of paper such as horizontal size A4 or A3 or a case of fixing vertical size A4 or other sheets of paper of small size, the driving ratio of induction heating coils 30, 40, and 50 is controlled, thus the temperature distribution of heat roller 27 in the longitudinal direction is made uniform.

Next, control system 100 for heating heat roller 27 will be described. As shown in the block diagram in FIG. 4, control system 100 for heating heat roller 27 has inverter circuit 60 for supplying a driving current to induction heating coils 30, 40, and 50, rectifier circuit 70 for supplying a DC supply voltage of 100 V to inverter circuit 60, and CPU 80 for controlling whole the entire image forming apparatus 1 and controlling inverter circuit 60 according to detection results of thermistors 32*a* and 32*b*. CPU 80, according to the detection results of thermistors 32*a* and 32*b*, may drive so as to output induction heating coil 30 or only either of induction heating coils 40 and 50 and may drive simultaneously induction heating coil 30 and both induction heating coils 40 and 50.

Rectifier circuit 70 is for 100 V and rectifies a current from commercial AC power source 71 to a direct current at 100 V and supplies it to inverter circuit 60. Between rectifier circuit 70 and commercial AC power source 71, power monitor 72 is connected, detects power supplied from commercial AC power source 71, and feeds it back to CPU 80.

Inverter circuit 60 uses a self excitation type semi-E class circuit. To induction heating coil 30 of inverter circuit 60, first capacitor 61*a* for resonance is connected in parallel to form first resonance circuit 61 and to induction heating coils 40 and 50 connected in series, second capacitor 62*a* for resonance is connected in parallel to form second resonance circuit 62. To first resonance circuit 61, first switching element 63*a* is connected in series to form first inverter circuit 63 and to second resonance circuit 62, second switching element 64*a* is connected in series to form second inverter circuit 64. Switching elements 63*a* and 64*a* use an IGBT usable at a high breakdown voltage and a large current. Switching elements 63*a* and 64*a* may be a MOSFET.

To the control terminals of switching elements 63*a* and 64*a*, IGBT driving circuits 66 and 67 for turning on switching elements 63*a* and 64*a* are respectively connected. CPU 80 controls the application timing of IGBT driving circuits 66 and 67. Inverter circuit 60 controls the ON time of switching elements 63*a* and 64*a* by CPU 80, thereby converts the frequency to 40 to 70 kHz. Induction heating coils 30, 40, and 50, by supply of a drive current at a frequency of 40 to 70 kHz, generate a predetermined magnetic field.

Figure 5:
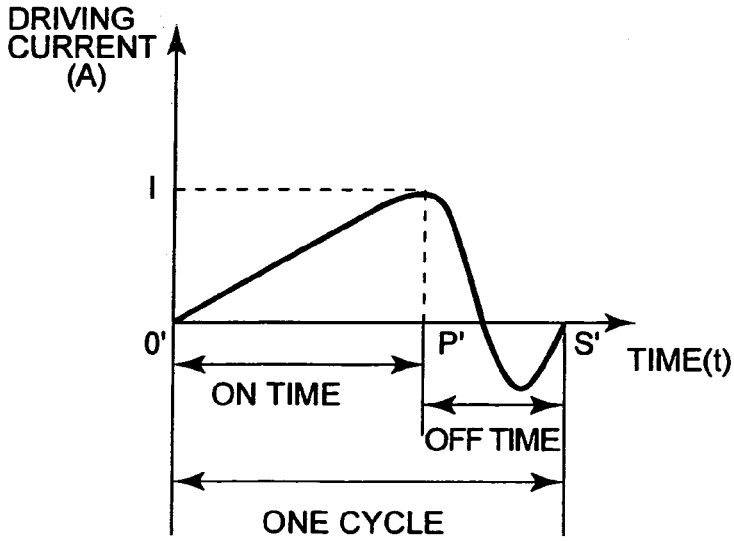
FIG. 5 is a schematic illustration showing one cycle by a switching element of the inverter circuit of the first embodiment of the present invention.

One cycle of the frequency by inverter circuit 60, as shown in FIG. 5, is the time of the ON time of switching elements 63*a* and 64*a* plus the OFF time thereof. The ON time (O'-P' shown in FIG. 5) of switching elements 63*a* and 64*a* is controlled by CPU 80 and the OFF time (P'-S' shown in FIG. 5) is the time until first capacitor 61*a* or second capacitor 62*a* is discharged. Namely, the OFF time of switching elements 63*a* and 64*a* varies with the temperature conditions of heat roller 26 and induction heating coils 30, 40, and 50. Therefore, the frequency by inverter circuit 60 varies with the shape of induction heating coils 30, 40, and 50 and the values of capacitors 61*a* and 62*a*.

Therefore, to drive induction heating coils 30, 40, and 50 at a frequency of 40 kHz or higher, the shape of induction heating coils 30, 40, and 50 must be changed from that of the coils driven at a frequency of 20 to 40 kHz.

Figure 6:
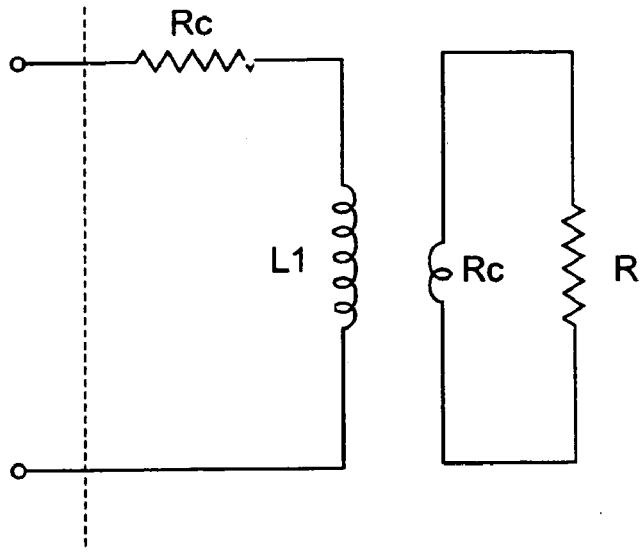
FIG. 6 is a table showing characteristics of the induction heating coil of the first embodiment of the present invention.

Next, the electric characteristics of induction heating coils 30, 40, and 50 will be considered. Firstly, generally, in the induction heating method, a transformer model in which the induction heating coil is assumed as primary side coil L1, and the loss part thereof is assumed as resistance Rc, and the heat roller is assumed as secondary side coil L2 and load resistance R is shown in FIG. 6. Firstly, load resistance R is greatly changed depending on the magnetic coupling intensity between the induction heating coil and the heat roller, and to instantaneously heat the heat roller by an eddy current generated on secondary side coil L2 by the magnetic field of primary side coil L1, load resistance R is preferably larger. Namely, when the ratio of load resistance R of secondary coil L2 which is a heat roller to inductance L of primary side coil L1 which is an induction heating coil is large, large output can be obtained by a small current.

Secondly, load resistance R varies with the frequency of the induction heating coil. When the frequency is increased, the penetration depth of the eddy current in the heat roller becomes shallow and the eddy current easily flows on the surface of the heat roller. Generally, when a current flows through a conductor, it is not distributed at a fixed density overall the section. The current is apt to flow through a part of secondary side coil L2, which is a heat roller, whose impedance is small. Generally, this current polarization is called a skin effect. The skin effect can be obtained remarkably as the frequency increases. The eddy current generated in the conductor flows on the surface of the conductor due to the skin effect, and when the frequency of the induction heating coil is increased due to changes in the penetration depth of the eddy current, load resistance R has a tendency to increase.

The degree of concentration of the current onto the surface is expressed by the depth of penetration of the current and Formula 1 is held.

$$\text{Depth of penetration}=503\times\sqrt{\rho/(\mu f)}\,(\text{cm}) \qquad \text{(Formula 1)}$$

where ρ: resistivity of conductor (Ω/cm),

μ: relative permeability of conductor, and f: frequency (Hz).

When the depth of penetration expressed by Formula 1 becomes smaller (shallow), the current flows more only on the surface of the conductor, and the current density is increased, and the heat value is also increased. In this embodiment, the frequency is increased, thus by the skin effect, efficient heat generation of metallic conductive layer 27*c* with a thickness of 40 μm is realized. For example, instead of the conventional frequency 20 kHz, induction heating coils 30, 40, and 50 are driven at 40 kHz, the depth of penetration becomes $1/\sqrt{2}$ times of the conventional one. Therefore, when the frequency is increased, load resistance R is increased and the leakage rate of the magnetic flux is reduced.

However, when the ratio of load resistance R to inductance L of the induction heating coil is small, to obtain the same output, the current may be increased. However, the current supplied to the induction heating coil is controlled and restricted according to the withstand current of the switching element such as an IGBT. Therefore, as long as the current supplied to the induction heating coil does not exceed the withstand current of the switching element, an experiment of obtaining a condition for obtaining a high heating efficiency by the heat roller is conducted and it is found that a ratio of L/R (H/Ω) of inductance L of the induction heating coil to load resistance R of the heat roller may conform to $L/R<35\times10^{-6}$ (H/Ω).

Further, even if the condition of the induction heating coil and heat roller conforms to $L/R<35\times10^{-6}$ (H/Ω), when the respective values of inductance L of the induction heating coil and load resistance R of the heat roller are too large and impedance Z is 10Ωor more, at a frequency of 40 kHz or higher, the heat roller cannot obtain a desired quantity of heat.

Therefore, the condition of the induction heating coil at a frequency of 40 kHz or higher and at a voltage of 100 V is that coil impedance Z (Ω) is Z<10Ω and the ratio of L/R (H/Ω) of inductance L of the induction heating coil to load resistance R of the heat roller is $L/R<35\times10^{-6}$ (H/Ω).

Induction heating coils 30, 40, and 50 of this embodiment conform to the aforementioned condition. In induction heating coils 30, 40, and 50, when the frequency is increased, the impedance is increased, so that within the conventional range from 20 to 40 kHz, although the number of turns of the coils is 14 turns, it can be reduced to 11 turns and the structure can be miniaturized.

When induction heating coils 30, 40, and 50 of this embodiment are driven at a frequency of 60 kHz or 40 kHz, inductance L and load resistance R show the results shown in FIG. 6. When the coils are driven at a frequency of 60 kHz (Experiment 1), inductance L is 16 (μH), and load resistance R is 1 (Ω), and $L/R=16\times10^{-6}$ (H/Ω) is held, and when the coils are driven at a frequency of 40 kHz (Experiment 2), inductance L is 17 (μH), and load resistance R is 0.8 (Ω), and $L/R=21\times10^{-6}$ (H/Ω) is held, and both cases conform to $L/R<35\times10^{-6}$ (H/Ω). On the other hand, when the frequency is set to 25 kHz (Comparison example 1), inductance L is 18 (μH), and load resistance R is 0.43 (Ω), and $L/R=42\times10^{-6}$ (H/Ω) is held. The values of inductance L and load resistance R are values measured by an LCR meter by changing the frequency.

As a result, the time required from supply of the drive current to induction heating coils 30, 40, and 50 by inverter circuit 60 to arrival of the surface temperature of heat roller 27 at 180° C. is 40 seconds in Comparison example 1, while it is 32 seconds in Experiment 1 and 35 seconds in Experiment 2, thus a high heating efficiency is obtained.

Next, the operation of the invention will be described. When the image forming process starts, in image forming unit 2, photosensitive drum 11 rotating in the direction of arrow q is uniformly charged by charger 12 and is irradiated with a laser beam according to document information by laser exposure apparatus 13, thus an electrostatic latent image is formed. Next, the electrostatic latent image is developed by developing apparatus 14 and a toner image is formed on photosensitive drum 11.

The toner image on photosensitive drum 11 is transferred onto the sheet of paper P by transfer charger 16. Next, the sheet of paper P is separated from photosensitive drum 11 and then is inserted between heat roller 27 rotating in the direction of arrow r of fixing device 26 and pressure roller 28 rotating in the direction of arrow s to heat, pressurize, and fix the toner image. In fixing device 26, according to detection results of the surface temperature of heat roller 27 by thermistors 32*a* and 32*b*, when necessary, first inverter circuit 63 or second inverter circuit 64 is driven by CPU 80 and a drive current, for example, at 60 kHz is supplied to induction heating coils 30, 40, and 50.

By doing this, the frequency of the drive current by the first or second inverter circuit 63 or 64 is high, so that by the skin effect of an eddy current generated by the magnetic field of induction heating coils 30, 40, and 50, a current is concentrated upon metallic conductive layer 27*c* of heat roller 27. Therefore, heat roller 27 reaches a desired fixable temperature at a high speed of about 32seconds and thereafter, the fixable temperature can be easily maintained and controlled under the ON-OFF control of inverter circuit 60.

According to this embodiment, the ratio of L/R (H/Ω) of inductance L of induction heating coils 30, 40, and 50 for a power source of 100 V to load resistance R of heat roller 27 is $L/R<35\times10^{-6}$ (H/Ω), and coil impedance Z (Ω) is set to Z<10Ω, and a drive current at a high frequency of 40 to 70 kHz is supplied. Therefore, even if metallic conductive layer 27*c* is formed thinly such as 40 μm, the eddy current generated by induction heating coils 30, 40, and 50 is concentrated upon metallic conductive layer 27*c* by the skin effect, and the leakage of the magnetic flux is reduced, and the heat generation efficiency of heat roller 27 can be improved. By doing this, rapid fixing, energy conservation, and precise temperature control can be realized easily.

Furthermore, when the frequency of the drive current of induction heating coils 30, 40, and 50 is increased, the impedance of induction heating coils 30, 40, and 50 can be increased. Therefore, compared with a case of using a drive current at a low frequency, the number of turns of electric wires 30*b*, 40*b*, and 50*b* for obtaining the same output can be reduced. As a result, miniaturization and lightweight of induction heating coils 30, 40, and 50 are realized and the degree of freedom of design of fixing device 26 can be improved.

Next, the second embodiment of the present invention will be explained. In the second embodiment, the electric characteristics of the induction heating coils are set to those for a power source of 200 V, thus an inverter circuit for 200 V is used, and the other is the same as that of the first embodiment. Therefore, in the second embodiment, to the same components as those of the first embodiment, the same numerals are assigned and the detailed explanation will be omitted.

Figure 7:
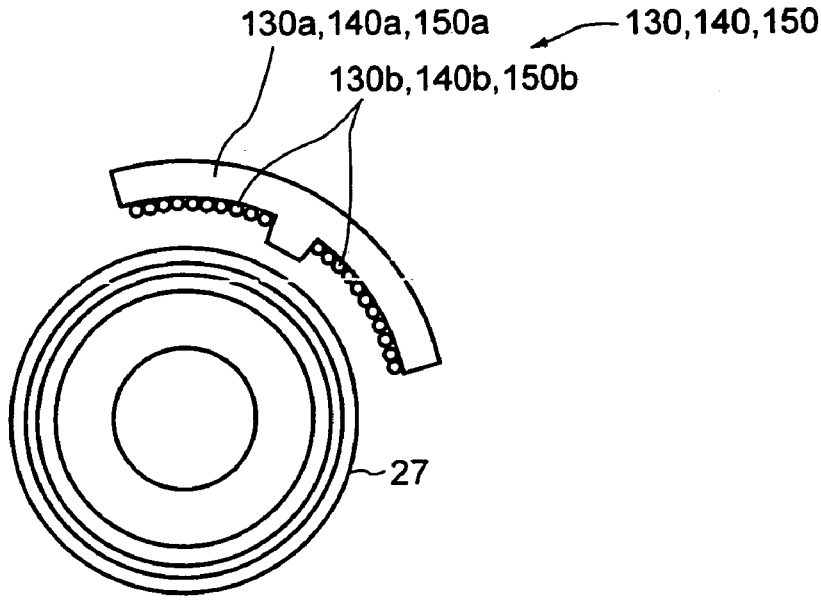
FIG. 7 is a schematic block diagram showing the heat roller and induction heating coil of the second embodiment of the present invention.

Although induction heating coils 130, 140, and 150 shown in FIG. 7 of the second embodiment have the electric characteristics for the power source of 200 V, the ratio L/R (H/Ω) of inductance L of induction heating coils 30, 40, and 50 for obtaining a high heating efficiency by metallic conductive layer 27*c* of heat roller 27 to load resistance R of heat roller 27, as described in the first embodiment, may conform to $L/R<35\times10^{-6}$ (H/Ω). However, the supply voltage is two times of that of the first embodiment such as 200 V, so that coil impedance Z (Ω) of induction heating coils 130, 140, and 150 is required to conform to Z<20Ω.

Therefore, this embodiment forms induction heating coils 130, 140, and 150 conforming to the aforementioned condition. Namely, induction heating coils 130, 140, and 150 for the 200 V power source are formed by winding electric wires 130*b*, 140*b*, and 150*b* round magnetic material cores 130*a*, 140*a*, and 150*a* by 18 turns. Further, within the conventional frequency range from 20 to 40 kHz, the coil impedance is small, so that the number of turns of the coil is increased to 22 turns. On the other hand, in this embodiment, the number of turns of the coil can be reduced to 18 turns, so that the induction heating coils can be miniaturized.

Further, electric wires 130*b*, 140*b*, and 150*b* of induction heating coils 130, 140, and 150 use heat resistant polyamide-imide copper wires. Electric wires 130*b*, 140*b*, and 150*b* are composed of a litz wire of 24 bundled copper wires with a wire diameter of 0.3 mm. Electric wires 30*b*, 40*b*, and 50*b* are formed as a litz wire, so that the copper loss can be suppressed. Compared with induction heating coils 30, 40, and 50 for the 100 V power source, the current flowing through induction heating coils 130, 140, and 150 is little, so that the number of twists of copper wires of the litz wire is reduced.

Further, rectifier circuit 70 is formed for 200 V, rectifies a current from commercial AC power source 71 to a direct current at 200 V, and supplies it to inverter circuit 60.

When induction heating coils 130, 140, and 150 of this embodiment are driven at a frequency of 60 kHz or 40 kHz, inductance L and load resistance R show the results shown in FIG. 8. When the coils are driven at a frequency of 60 kHz (Experiment 3), inductance L is 80 (μH), and load resistance R is 4.1 (Ω), and $L/R=20\times10^{-6}$ (H/Ω) is held, and when the coils are driven at a frequency of 40 kHz (Experiment 4), inductance L is 85 (μH), and load resistance R is 3.2 (Ω), and $L/R=27\times10^{-6}$ (H/Ω) is held, and both cases conform to $L/R<35\times10^{-6}$ (H/Ω).

As a result, the time required from supply of the drive current to induction heating coils 130, 140, and 150 by inverter circuit 60 to arrival of the surface temperature of heat roller 27 at 180° C. is 28 seconds in Experiment 3, while it is 32 seconds in Experiment 4, thus a high heating efficiency is obtained.

According to this embodiment, the ratio of L/R (H/Ω) of inductance L of induction heating coils 130, 140, and 150 for the power source of 200 V to load resistance R of heat roller 27 is $L/R<35\times10^{-6}$ (H/Ω), and coil impedance Z (Ω) is set to Z<20Ω, and a drive current at a high frequency of 40 to 70 kHz is supplied. Therefore, in the same way as with the first embodiment, the eddy current generated by induction heating coils 130, 140, and 150 is concentrated upon metallic conductive layer 27*c* formed thinly such as 40 μm, and the leakage of the magnetic flux is reduced, and the heat generation efficiency of heat roller 27 can be improved. By doing this, in fixing device 26, rapid fixing, energy conservation, and precise temperature control during fixing can be realized easily.

Furthermore, compared with a case of using a drive current at a low frequency, the number of turns of electric wires 130*b*, 140*b*, and 150*b* for obtaining the same output can be reduced. As a result, miniaturization and lightweight of induction heating coils 130, 140, and 150 are realized and the degree of freedom of design of fixing device 26 can be improved.

Next, the third embodiment of the present invention will be explained. The third embodiment is different from the first embodiment in that even if the supply voltage used by the induction heating coils is either of 100 V and 200 V, induction heating coils having the same electric characteristics are used and the other is the same as that of the first embodiment. Therefore, in the third embodiment, to the same components as those of the first embodiment, the same numerals are assigned and the detailed explanation will be omitted.

As shown in FIG. 9 of the third embodiment, induction heating coils 230, 240, and 250 may conform to that within the drive frequency range from 20 to 40 kHz of inverter circuit 60 driven by 100 V power source 270, coil impedance Z (Ω) is Z<10Ω and the ratio of L/R (H/Ω) of inductance L of the induction heating coils to load resistance R of the heat roller is $L/R<35\times10^{-6}$ (H/Ω).

Further, simultaneously, as shown in FIG. 10, induction heating coils 230, 240, and 250 make it a condition that the frequency when driving inverter circuit 60 by 200 V power source 280 is within the range from 50 to 80 kHz, and coil impedance Z (Ω) is Z<20Ω, and the ratio of L/R (H/Ω) of inductance L of the induction heating coils to load resistance R of the heat roller is $L/R<35\times10^{-6}$ (H/Ω). The electric characteristics of induction heating coils 230, 240, and 250 are shared by 100 V power source 270, so that the coil impedance has a tendency to be reduced. Therefore, when driving induction heating coils 230, 240, and 250 by 200 V power source 280, the frequency is increased to 50 to 80 kHz to obtain a predetermined output.

When the induction heating coils do not conform to the aforementioned condition, to generate a minimal quantity of heat fixable in fixing device 26, the drive frequency of inverter circuit 60 driven by 100 V power source 270 is reduced to 20 kHz or lower. Namely, inverter circuit 60 must be driven at a frequency in the audible zone and noise is caused at the time of driving.

Further, the coil impedance is preferably not too low. When the coil impedance is low, if the coils are driven by 200 V power source 280, the frequency must be made higher. However, when the frequency is increased, highly efficient switching elements 63*a* and 64*a* must be used and the cut-down of cost is disturbed. On the other hand, when low-priced general-purpose switching elements 63*a* and 64*a* are used, as the frequency is increased, the characteristics of switching elements 63*a* and 64*a* are deteriorated and the switching efficiency is reduced. Therefore, coil impedance for enabling the frequency when driving inverter circuit 60 to retain a range of not deteriorating switching elements 63*a* and 64*a* is desirable.

Therefore, this embodiment forms induction heating coils 230, 240, and 250 conforming to the aforementioned condition. Namely, induction heating coils 230, 240, and 250 shared by 100 V power source 270 and 200 V power source 280 are formed by winding electric wires 230*b*, 240*b*, and 250*b* round magnetic material cores 230*a*, 240*a*, and 250*a* by 16 turns. Electric wires 230*b*, 240*b*, and 250*b* of induction heating coils 230, 240, and 250 are composed of a litz wire of 50 bundled heat resistant polyamide-imide copper wires with a wire diameter of 0.3 mm. Electric wires 230*b*, 240*b*, and 250*b* share the same induction heating coils 230, 240, and 250 for 100 V power source 270 and 200 V power source 280, so that the electric wires have a litz wire structure of 100 V power source 270 in which a large current flows. Further, when 200 V power source 28 is used, in the conventional fixing device in which the frequency is within the range from 20 to 40 kHz, the coil impedance is low, so that the number of turns of the coil is increased to 22 turns. On the other hand, induction heating coils 230, 240, and 250, since the number of turns can be reduced to 16 turns, are miniaturized.

When induction heating coils 230, 240, and 250 of this embodiment are driven at a frequency of 40 kHz or 20 kHz by 100 V power source 270, inductance L and load resistance R show the results shown in FIG. 11. When the coils are driven at a frequency of 40 kHz (Experiment 5), inductance L is 28(μH), and load resistance R is 1.7 (Ω), and $L/R=16\times10^{-6}$ (H/Ω) is held, and when the coils are driven at a frequency of 20 kHz (Experiment 6), inductance L is 30 (μH), and load resistance R is 1.1 (Ω), and $L/R=27\times10^{-6}$ (H/Ω) is held, and both cases conform to $L/R<35\times10^{-6}$ (H/Ω).

Further, when induction heating coils 230, 240, and 250 are driven at a frequency of 80 kHz or 50 kHz by 200 V power source 280, inductance L and load resistance R show the results shown in FIG. 12. When the coils are driven at a frequency of 80 kHz (Experiment 7), inductance L is 26 (μH), and load resistance R is 2.6 (Ω), and $L/R=10\times10^{-6}$ (H/Ω) is held, and when the coils are driven at a frequency of 50 kHz (Experiment 8), inductance L is 27 (μH), and load resistance R is 1.9 (Ω), and $L/R=14\times10^{-6}$ (H/Ω) is held, and both cases conform to $L/R<35\times10^{-6}$ (H/Ω).

According to this embodiment, the ratio of L/R (HΩ) of inductance L of induction heating coils 230, 240, and 250 to load resistance R of heat roller 27 is set to $L/R<35\times10^{-6}$ (H/Ω), and when 100 V power source 270 is used, coil impedance Z (Ω) is set to Z<10Ω, and when 200 V power source 280 is used, coil impedance Z (Ω) is set to Z<20Ω. By doing this, induction heating coils 230, 240, and 250 common to both 100 V power source 270 and 200 V power source 280 can be used. Therefore, by common use, induction heating coils 230, 240, and 250 can be mass-produced and the cost can be reduced.

Further, when driving induction heating coils 230, 240, and 250 by 200 V power source 28, the frequency is increased to 50 to 80 kHz. Therefore, even if metallic conductive layer 27*c* is formed thinly such as 40 μm, the eddy current generated by induction heating coils 230, 240, and 250 is concentrated upon metallic conductive layer 27*c* by the skin effect, and the leakage of the magnetic flux is reduced, and the heat generation efficiency of heat roller 27 can be improved.

Furthermore, compared with the conventional induction heating coils for the 200 V power source driven at a low frequency, induction heating coils 230, 240, and 250 of this embodiment are driven at a high frequency of 50 to 80 kHz, so that even if the number of turns of electric wires 230*b*, 240*b*, and 250*b* is reduced, the same output can be obtained. Therefore, compared with the conventional induction heating coils, in induction heating coils 230, 240, and 250 of this embodiment, the number of turns of electric wires 230*b*, 240*b*, and 250*b* can be reduced, and miniaturization and lightweight of induction heating coils 230, 240, and 250 are realized, and the degree of freedom of design of fixing device 26 can be improved.

Further, the present invention is not limited to the aforementioned embodiments and within the scope of the present invention, can be modified variously, and for example, the endless member may be in a belt shape, and the material of the metallic conductive layer may be unrestrictedly stainless steel, aluminum, or a composite material of stainless steel and aluminum. Further, the thickness of the metallic conductive layer is not restricted and optional. However, to reduce the thermal capacity, shorten the warming-up time, realize energy conservation, and exactly control the temperature, the metallic conductive layer is desirably thinned to 10 to 100 μm or so. Further, the conveying direction of a medium to be fixed by the fixing device is also optional and an apparatus for conveying vertically a medium to be fixed is acceptable.

Further, if the induction heating coils conform to $L/R<35\times10^{-6}$ (H/Ω) and the coil impedance setting condition, the shape thereof, the wire thickness and kind, and the number of turns of wires are not limited. Furthermore, the kind and characteristics of electronic parts such as the switching elements used in the inverter circuit are not limited and they may supply a desired current to the induction heating coils. Further, this embodiment is based on the fixing device in which the coils are arranged outside the rollers. However, the embodiment can be applied also to a fixing device in which the coils are arranged inside the heat rollers.

As described above, according to the present invention, by the induction heating coils, the heat generation efficiency of the metallic conductive layer can be improved and rapid fixing, energy conservation, and precise temperature control can be realized easily. Further, miniaturization and lightweight of the induction heating coils are realized and the degree of freedom of design of the fixing device can be improved.

What is claimed is:

1. A fixing device of an image forming apparatus, comprising:

heating means having a conductive heat generation layer for heating a toner image on a medium;

pressure means pressed to the heating means for conveying the medium in a predetermined direction;

induced current generation means arranged near the heating means for setting a ratio of a load resistance R (Ω) generated between an inductance L (H) and the heating means to $L/R<35\times10^{-6}$ (H/Ω) and generating an induced current in the heat generation layer; and current control means for supplying a drive current at a frequency of 40 kHz or higher to the induced current generation means.

2. The fixing device of an image forming apparatus according to claim 1, wherein the current control means is driven by a 100 V power source.

3. The fixing device of an image forming apparatus according to claim 2, wherein a coil impedance Z (Ω) of the induced current generation means is Z<10(Ω).

4. The fixing device of an image forming apparatus according to claim 1, wherein the current control means is driven by a 200 V power source.

5. The fixing device of an image forming apparatus according to claim 4, wherein a coil impedance Z (Ω) of the induced current generation means is Z<20 (Ω).

6. The fixing device of an image forming apparatus according to claim 1, wherein the heat generation means layer is provided on a surface side of the heating means.

7. The fixing device of an image forming apparatus according to claim 6, wherein the heat generation means layer has a protective layer on an uppermost surface.

8. The fixing device of an image forming apparatus according to claim 1, wherein the heat generation means layer has a thickness of 10 to 100 μm.

9. A fixing device of an image forming apparatus, comprising:

an endless member having a metallic conductive layer;

a pressure member pressed to the endless member to convey a medium having a toner image in a predetermined direction;

an induction heating coil arranged near the endless member to set a ratio of a load resistance R (Ω) generated between an inductance L (H) and the endless member to $L/P<35\times10^{-6}$ (H/Ω) and to generate an induced current in the metallic conductive layer; and a current source to supply a drive current at a frequency of 40 kHz or higher to the induction heating coil.

10. The fixing device of an image forming apparatus according to claim 9, wherein the current source is driven by a 100 V power source.

11. The fixing device of an image forming apparatus according to claim 10, wherein a coil impedance Z (Ω) of the induction heating coil is Z <10(Ω).

12. The fixing device of an image forming apparatus according to claim 9, wherein the current source is driven by a 200 V power source.

13. The fixing device of an image forming apparatus according to claim 12, wherein a coil impedance Z (Ω) of the induction heating coil is Z <20(Ω).

14. The fixing device of an image forming apparatus according to claim 9, wherein the metallic conductive layer is provided on a surface of the endless member.

15. The fixing device of an image forming apparatus according to claim 9, wherein the metallic conductive layer has a thickness of 10 to 100 μm.

16. A method for manufacturing a fixing device of an image forming apparatus, comprising:

providing an endless member with a metallic conductive layer;

conveying a medium having a toner image in a predetermined direction;

setting a ratio of a load resistance R (Ω) generated between an inductance L (H) and the endless member to $L/R<35\times10^{-6}$ (H/Ω);

generating an induced current in the metallic conductive layer; and supplying a drive current at a frequency of 40 kHz or higher to an induction heating coil.

17. The method for manufacturing a fixing device of an image forming apparatus according to claim 16, further comprising supplying the drive current with a 200 V power source.

18. The method for manufacturing a fixing device of an image forming apparatus according to claim 17, further comprising providing a coil impedance Z (Ω) of the induction heating coil of Z<20(Ω).

19. The method for manufacturing a fixing device of an image forming apparatus according to claim 16, further comprising providing the metallic conductive layer on a surface of the endless member.

20. The method for manufacturing a fixing device of an image forming apparatus according to claim 16, further comprising providing the metallic conductive layer with a thickness of 10 to 100 μm.

21. A method for manufacturing a fixing device of an image forming apparatus, comprising:

providing an endless member with a metallic conductive layer;

conveying a medium having a toner image in a predetermined direction;

setting a ratio of a load resistance R (Ω) generated between an inductance L (H) and the endless member to $L/R<35\times10^{-6}$ (H/Ω);

generating an induced current in the metallic conductive layer;

supplying a drive current at a frequency of 40 kHz or higher to an inducting heating coil; and supplying the drive current with a 100 V power source.

22. The method for manufacturing a fixing device of an image forming apparatus according to claim 21, further comprising providing a coil impedance Z (Ω) of the induction heating coil of Z<10(Ω).

* * * * *